United States Patent [19]

Mori et al.

[11] Patent Number: 4,784,274

[45] Date of Patent: Nov. 15, 1988

[54] BILL DEVICE

[75] Inventors: Yoshikazu Mori; Susumu Kozima; Masayuki Watabe; Hideaki Onda; Shigeru Yasuda, all of Saitama, Japan

[73] Assignee: Kabushiki Kaisha Nippon Coinco, Tokyo, Japan

[21] Appl. No.: 73,388

[22] Filed: Jul. 13, 1987

Related U.S. Application Data

[63] Continuation of Ser. No. 6,656,769, Oct. 1, 1984, abandoned.

[30] Foreign Application Priority Data

Oct. 3, 1983 [JP] Japan ..... 58-184847
Nov. 25, 1983 [JP] Japan ..... 58-180889[U]

[51] Int. Cl.[4] ..... B07C 5/02

[52] U.S. Cl. ..... 209/534; 194/206; 235/379; 271/259; 271/260; 271/273

[58] Field of Search ..... 209/534, 539, 548, 552, 209/653; 194/206, 207; 271/259, 260, 273; 235/379; 109/24.1

[56] References Cited

U.S. PATENT DOCUMENTS

| | | | |
|---|---|---|---|
| 3,108,680 | 10/1963 | Ellis et al. | 194/4 E |
| 3,447,655 | 6/1969 | Tanaka et al. | 194/206 |
| 4,011,931 | 3/1977 | Wyckoff | 209/534 |
| 4,034,838 | 7/1977 | Uchida | 209/534 |
| 4,050,562 | 9/1977 | Schwippert et al. | 194/4 E |
| 4,096,991 | 6/1978 | Iguchi | 209/534 |
| 4,348,656 | 9/1982 | Gorgone et al. | 209/534 |
| 4,473,157 | 9/1984 | Hirose et al. | 209/534 |
| 4,540,081 | 9/1985 | Mori et al. | 194/4 C |
| 4,556,139 | 12/1985 | Akagawa et al. | 209/534 |
| 4,678,072 | 7/1987 | Kobayashi et al. | 209/534 |
| 4,682,768 | 7/1987 | Iida et al. | 209/534 |

FOREIGN PATENT DOCUMENTS

| | | | |
|---|---|---|---|
| 0060190 | 5/1977 | Japan | 194/207 |
| 0040596 | 4/1978 | Japan | 194/206 |
| 0093767 | 7/1980 | Japan | 271/273 |

*Primary Examiner*—Robert B. Reeves
*Assistant Examiner*—Donald T. Hajec
*Attorney, Agent, or Firm*—Spensley Horn Jubas & Lubitz

[57] ABSTRACT

This bill device is constituted of a relatively elongated casing. A bill insertion slit is formed substantially in the center of this casing in its longitudinal direction. A first U-shaped bill conveying passage communicating with the bill insertion slit is provided in one half of the casing and a second U-shaped bill conveying passage communicating with this first U-shaped bill conveying passage is provided in another half of the casing. A bill discrimination section is disposed in the former half of the first U-shaped bill conveying passage and a bill accumulating device is disposed in the latter half of the second bill conveying passage such that a plurality of bills after discrimination are retained in the two U-shaped bill conveying passages. In a case where a part of the temporarily retained bills are accepted and the rest of the bills are returned, a bill return operation is performed prior to a bill accumulating operation such that a required number of bills are returned first from among temporarily retained bills and thereafter the rest of the bills are accepted into the bill accumulating device.

11 Claims, 9 Drawing Sheets

ACCUMULATION OPERATION

56
TIMER T SET
3 sec.
M3 FORWARD
SW1 ON ?
NO
YES
T ELAPSE ?
NO
YES
MALFUNCTION
TIME DELAY
300 ms
57
SW1 OFF ?
NO
YES
M3 STOP
58
59
N ← N − 1
RETURN
60
T ELAPSE ?
NO
YES
M3 STOP
TIMER T SET
3 sec.
M3 REVERSE
61
SW1 OFF ?
NO
YES
T ELAPSE ?
NO
YES
MALFUNCTION
FULLNESS FLAG SET
RETURN

BILL DEVICE

This is a continuation of application Ser. No. 06/656,769 filed on Oct. 1, 1984, now abandoned.

BACKGROUND OF THE INVENTION

This invention relates to a bill device used in a vending machine, an exchanger or the like device and, more particularly, to improvements in construction of such bill device and to a control for returning a part of once received and temporarily retained bills and accepting the rest of bills into a bill accumulating device.

Known in the art are various constructions of a bill device having functions of discriminating a true bill from a counterfeit one among bills inserted from a bill insertion slit, temporarily retaining a true bill which has been received upon discrimination, and returning the retained bill or accepting it into a bill accumulating section as required. For example, there is a known bill device which comprises a bill discrimination section, a stacker section for accumulating a large number of bills in unreturnable state and an escrow section for retaining a large number of bills in a returnable state in which these bills are wound on a drum (Japanese patent application No. 131462/1981 filed on Aug. 24, 1981 and U.S. patent application Ser. No. 409,017 filed on Aug. 17, 1982 now U.S. Pat. No. 4,513,80). While this type of bill device is advantageous when it is required to temporarily retain a large number of bills, it has the disadvantage that the device as a whole tends to become large because it requires extra space for provision of the escrow section.

There is also known a bill device which consists only of a bill discrimination section and a stacker section and in which bills are temporarily retained somewhere in a bill conveying passage leading from the bill discrimination section to the stacker section. This device however has been found inadequate because the bill conveying passage is of a straight line construction and can scarcely retain more than one bill.

It is, therefore, an object of the present invention to provide a bill device of a nevel construction which is of a compact construction and yet capable of temporarily retaining as many bills as possible.

In a case where such a control is realized that plural bills can be temporarily retained somewhere in a bill conveying passage leading from a bill discrimination section to a stacker section and a part of the retained bills are accepted into a bill accumulating device as a sales amount and returning the rest of bills as change, there arises a problem as to which of the bill returning operation and the bill accepting operation should be given priority. If the bill accepting operation is performed first, there occurs delay in returning of bills because the bill accumulating operation requires time with a result that purchasers are put to inconvenience.

It is, therefore, another object of the invention to provide a control device for a bill device which enables a control such that a part of plural bills retained in temporary retention means are accepted into a bill accumulating section and the rest of bills are returned and further that the bill returning operation is performed first and thereafter the bill accepting operation is performed for the convenience to the purchasers.

SUMMARY OF THE INVENTION

The bill device according to the present invention is characterized in that a main body of the bill device is constituted of a relatively elongated casing, a bill insertion slit is formed substantially in the center of the casing in its longitudinal direction, a first U-shaped bill conveying passage communicating with the bill insertion slit is provided in one half of the casing and a second U-shaped bill conveying passage communicating with the first U-shaped bill conveying passage is provided in another half of the casing, the bill discrimination means is disposed in the former falf of the first U-shaped bill conveying passage and the bill accumulating device is disposed in the latter half of the second bill conveying passage such that a plurality of bills after discrimination are retained in the two U-shaped bill conveying passages, so that the retained bills are returned to the bill insertion slit or accepted into the bill accumulating device and accumulated therein as required. Since the bill insertion slit is provided substantially in the center of the casing and the bill conveying passage is made of two U-shaped bill conveying passages communicating with each other, the longest possible bill conveying passage can be formed within a relatively compact casing whereby as many bills as possible can be retained in the bill conveying passage.

The bill device achieving the other object of the present invention is capable of accepting a part of plural bills retained temporarily and returning the rest of bills and comprises return and accept control means for effecting such returning accepting controls. This return and accept control means generates a return signal prior to an accept signal and supplies it to return control means and thereafter generates the accept signal and supplies it to accept control means, so that a required number of bills are returned first from among the retained bills and thereafter the rest of bills are accepted into the bill accumulating device.

DESCRIPTION OF A PREFERRED EMBODIMENT

Figure 1:
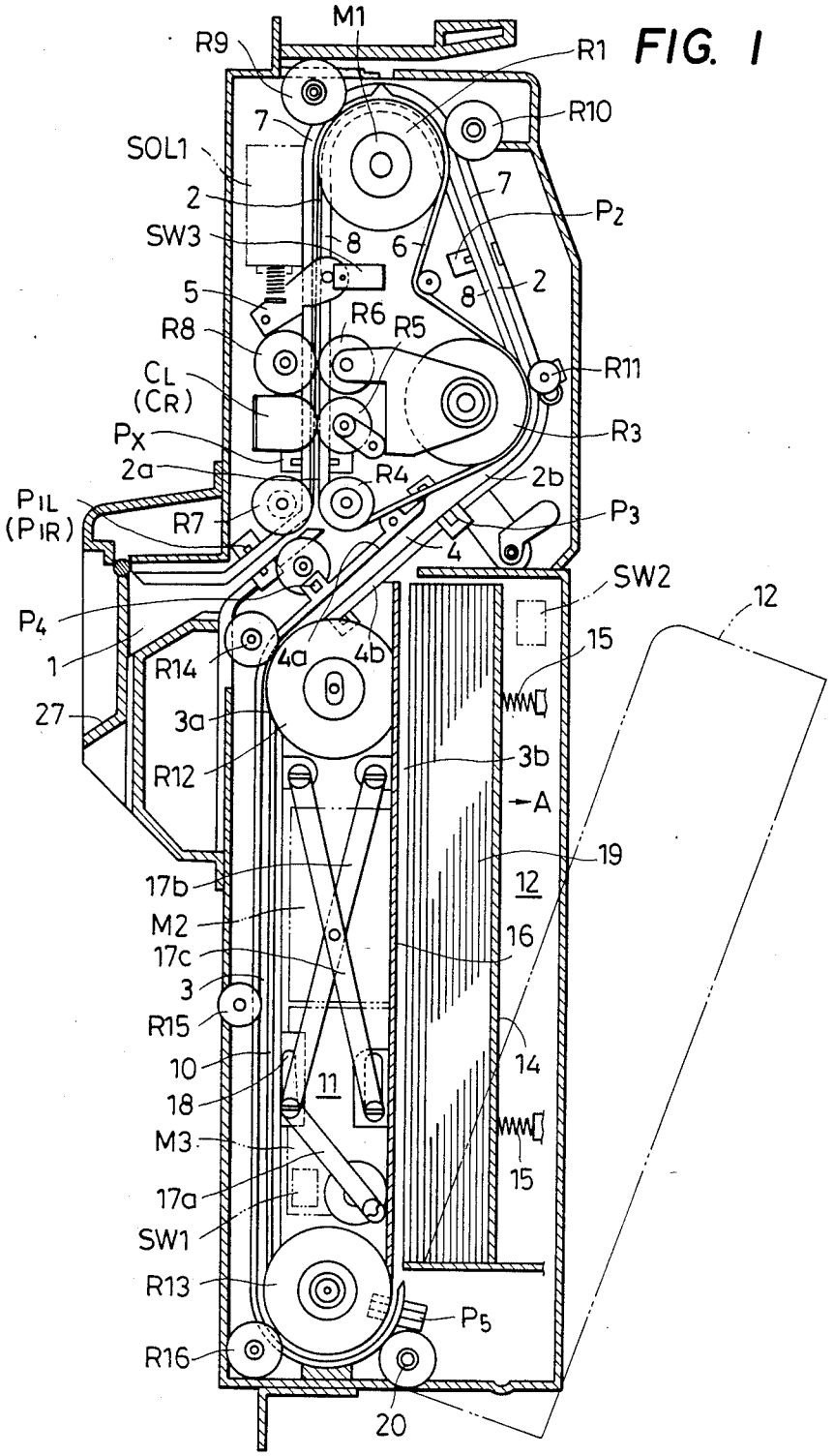
FIG. 1 is a sectional elevation showing an embodiment of the bill device according to the invention.

FIG. 1 is a sectional elevation showing an embodiment of the bill device according to the invention. The bill device according to the invention comprises an elongated casing provided with a bill insertion slit 1 almost in the center of its front panel. There are provided above the bill insertion slit 1 or in the upper half of the casing an inverted U-shaped bill conveying passage 2 and, below the bill insertion slit 1 or in the lower half of the casing, an uninverted U-shaped bill conveying passage 3 (hereinafter referred to as U-shaped bill conveying passage). One end 2*a* of the inverted U-shaped bill conveying passage 2 communicates with the bill insertion slit 1 while the other end 2*b* communicates through an intermediate portion 4 with one end 3*a* of the U-shaped bill conveying passage 3. There are provided along the first half of the inverted U-shaped bill conveying passage 2 bill sensors $P_{1L}$, $P_{1R}$, $P_X$ and magnetic heads $C_L$, $C_R$. which function as detector elements of the discrimination means. The two sensors $P_{1L}$, $P_{1R}$, provided adjacent to the bill insertion slit 1, are disposed side by side on the left and right side of the passage so that the distance between them corresponds to the length of the width of a bill. The sensors $P_{1L}$, $P_{1R}$ detect the insertion of a bill and also check the length of the width of the inserted bill. The sensor $P_X$ checks the watermark of the inserted bill. The two magnetic heads $C_L$, $C_R$ disposed side by side to detect the magnetic contents contained in the bill printing ink. A check shutter 5 is provided ahead of these bill discrimination means. The shutter 5, normally allowed to project into the bill conveying passage, is pushed out of the bill conveying passage by the bill conveyed in the accepting direction, thereby permitting the accepted bill to pass. A shutter switch SW3 consisting of a photo-interrupter is off when the shutter 5 is in the passage and closed when the shutter 5 retracts from the passage. A shutter solenoid SOL1 is actuated, when the inserted bill is to be returned, to force the bill out of the passage, thereby permitting the bill reversely conveyed toward the bill insertion slit 1 to pass. The second half of the inverted U-shaped conveying passage 2 between the shutter 5 and the end 2*b* is long enough to retain a bill lengthwise. A sensor $P_2$ is provided about in the middle of that second half.

Figure 2:
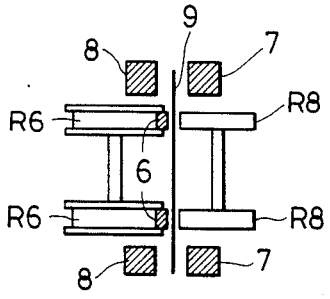
FIG. 2 is a cross section showing an example of the structure of the bill conveying passage in this embodiment.

The inverted U-shaped bill conveying passage 2 is defined by a plurality of guide members including belts, pulleys, rollers and walls. Within the passage 2 there are provided bill conveying belts 6 and a motor M1 for driving the belts 6. Pulleys R1 to R6 are provided to help drive the belts. Rollers R7 to R11 press the bill from the opposite side of the belts 6 to the pulleys R1 to R6 so as to help convey the bill. The conveying passage 2 has a cross section as shown, for example, in FIG. 2. More specifically, a pair of walls 7,7 and 8, 8 are provided on both sides of the passage 2 and spaced from each other by the distance corresponding to the length of the width of the acceptable bill. Inside these walls, a pair of pulleys R6,R6 are provided in appropriate positions, over which pulleys a pair of belts 6,6 are passed. A pair of rollers R8,R8 are provided on the opposite side of the belts 6 to these pulleys. A bill 9 is shown in its cross section.

The U-shaped second passage 3 is also defined by a plurality of guide numbers including belts, pulleys, rollers, plates and walls. Within the U-shaped second passage 3 there are provided bill conveying belts 10 and a motor M2 for driving the belts 10. The belts 10 are passed over pulleys R12, R13. The rotation of the motor M2 is transmitted through some transmission means (not shown) to the pulleys R13 to drive the belts 10. Rollers R14 to R16 are provided to press the bill from the opposite side of the belts to the pulleys R13,R14 so as to help convey the bill. Each of the straight former and latter half of the second passage 3 is long enough to retain a bill lengthwise. A bill accumulation device is disposed along the latter half of the second passage 3. This bill accumulation device is equipped with a reciprocating means 11 inside the space defined by the U-shaped passage 3 and a bill accumulating box 12 outside said space.

Figure 3:
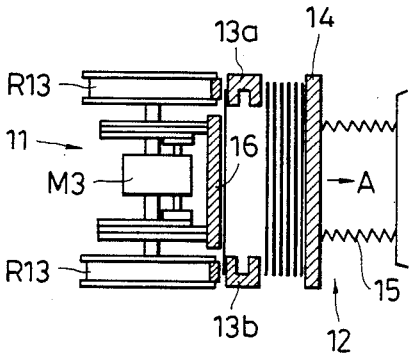
FIG. 3 is a cross section showing the structure of the bill accumulating device in the same embodiment.

As shown in FIG. 3, the bill accumulating box 12 comprises two elongated channel members 13*a*, 13*b* disposed vertically and parallel to each other with a given space between them which is somewhat narrower than the length of the width of the bill, and a bill compressing plate 14 having a somewhat larger area than the bill and disposed vertical or parallel to the channel members 13*a*,13*b*. The channel members 13*a*, 13*b* are fixedly provided while the bill compressing plate 14 is movable in a translatory motion in the direction perpendicular to the plane in which it lies and urged all the time toward the channel members 13*a*, 13*b* by a spring 15.

The reciprocating means 11 comprises a push plate 16 almost parallel to the bill compressing plate 14, and links 17*a*, 17*b*, 17*c* for reciprocating the push plate 16 in response to the rotation of the motor M3. The rotation of the motor M3 causes one end of the link 17*a* to revolve so that the other end reciprocates along a fixed slot 18. Accordingly the link 17*b* of which one end is pivotally joined with said other end of the link 17*a* is moved, causing the link 17*c* which is pivotally connected with the link 17*b* at their intersection, which is located in the middle of the links 17*b*, 17*c*, to move also. The push plate 16 is connected with the link 17*b*, 17*c* so as to reciprocate in a translatory motion in the direction perpendicular to the plane in which it lies or in the direction of the bill compressing plate 14 as the links 17*b*, 17*c* move. As shown, the push plate 16 normally is in the farthest position from the accumulating box 12, providing a passage between the push plate 16 and the channel members 13*a*, 13*b* for the bill to pass. A carrier switch SW1 is provided in association with the motor M3.

The length of the push plate 16 almost corresponds to the counterpart of the bill while the width of the push plate 16 is narrower than the counterpart of the bill. Therefore the push plate 16 can move toward the compressing plate 14 through the channel members 13*a*, 13*b*.

To introduce the bill in the accumulating box 12, the bill is positioned in the straight second half 3*b* of the U-shaped conveying passage 3, where the bill is parallel to the push plate 16. Then the motor M3 is rotated to reciprocate the push plate 16. The push plate 16 urges the bill as it approaches the compressing plate 14 through the channel members 13*a*, 13*b* (the bill is bent as it passes between the members 13*a*, 13*b*) and, pressing the bill to the compressing plate 14 against the force of the spring 15, moves the compressing plate 14 in the direction indicated by an arrow A. As a result, a space is produced between the channel members 13*a*, 13*b* and the compression plate 14, in which space the pushed bill is placed. As the push plate 16 returns to its original position, the compressing plate 14 is moved toward the channel members 13*a*, 13*b* by the force of the spring 15 until it comes into a pressure contact with the channel members 13*a*, 13*b*, so as to press and hold the bill between the compressing plate 14 and the channel members 13*a*, 13*b*. The push plate 16 returns to its initial position, leaving the bill held in this way. Thus numerous bills 19 are accumulated between the channel members 13*a*, 13*b* and the compressing plate 14.

The slant intermediate portion 4 between the end 2*b* of the first conveying passage 2 and the beginning 3*a* of the second conveying passage 3 merely consists of walls 4*a*, 4*b* defining a passage space and is not provided with special drive means for conveying the bill. The intermediate portion 4 is provided with a bill sensor $P_3$ at its one end adjacent to the first conveying passage 2 and another bill sensor $P_4$ at its other end adjacent to the second conveying passage 3. These two sensors $P_3$, $P_4$ independently detect the bill either accepted or returned through the conveying passages 2, 3 from each other so as to asynchronously control the drives of the conveying passages 2, 3 in the acceptance and return of the bill, thus securing an effective bill-conveying and temporary bill-retention control. Before the straight latter half 3*b* of the second conveying passage 3, there is provided a sensor $P_5$ which detects the bill accepted to or returned from the straight latter half 3*b*. The distance between the sensors $P_4$ and $P_5$ is somewhat longer than the length of the bill. The sensors $P_{1L}$ to $P_5$ consist of photosensors.

The above structure enables a maximum of three bills to be temporarily retained in the conveying passages 2, 3, specifically one bill in the latter half of the first conveying passage 2, another bill in the former half of the second passage 3 and the other bill in the latter half of the second conveying passage 2 (the straight latter half 3*b*). These conveying passages constitute the temporary retention means. The motors M1, M2 are capable of revolving in either direction, i.e., in a forward direction to accept a bill and in the reverse direction to return one. A bill retained in the latter half of the first conveying passage 2 can be returned to the insertion slit 1 by rotating only the motor M1 in the reverse direction whereas a bill retained in either half of the second conveying passage 3 can be returned to the insertion slit by rotating the motors M2 and M1 in the reverse direction.

The bill accumulating box 12 can be pivoted backward on a shaft 20 provided adjacent to the bottom of the casing, as shown by a chain-and-dot line 12' in FIG. 1, enabling an easy collection of the bills 19 accumulated in the box 12. A safety switch SW2 is provided in association with the box 12 to detect the disengagement of the box 12 from the casing into the position 12' and prevents the drive of the motors M1 and M2, namely, insertion of a bill while the box is in the position 12' (alternatively, the motor M1 is rotated in said reverse direction to prevent deposition of a bill).

Figure 4:
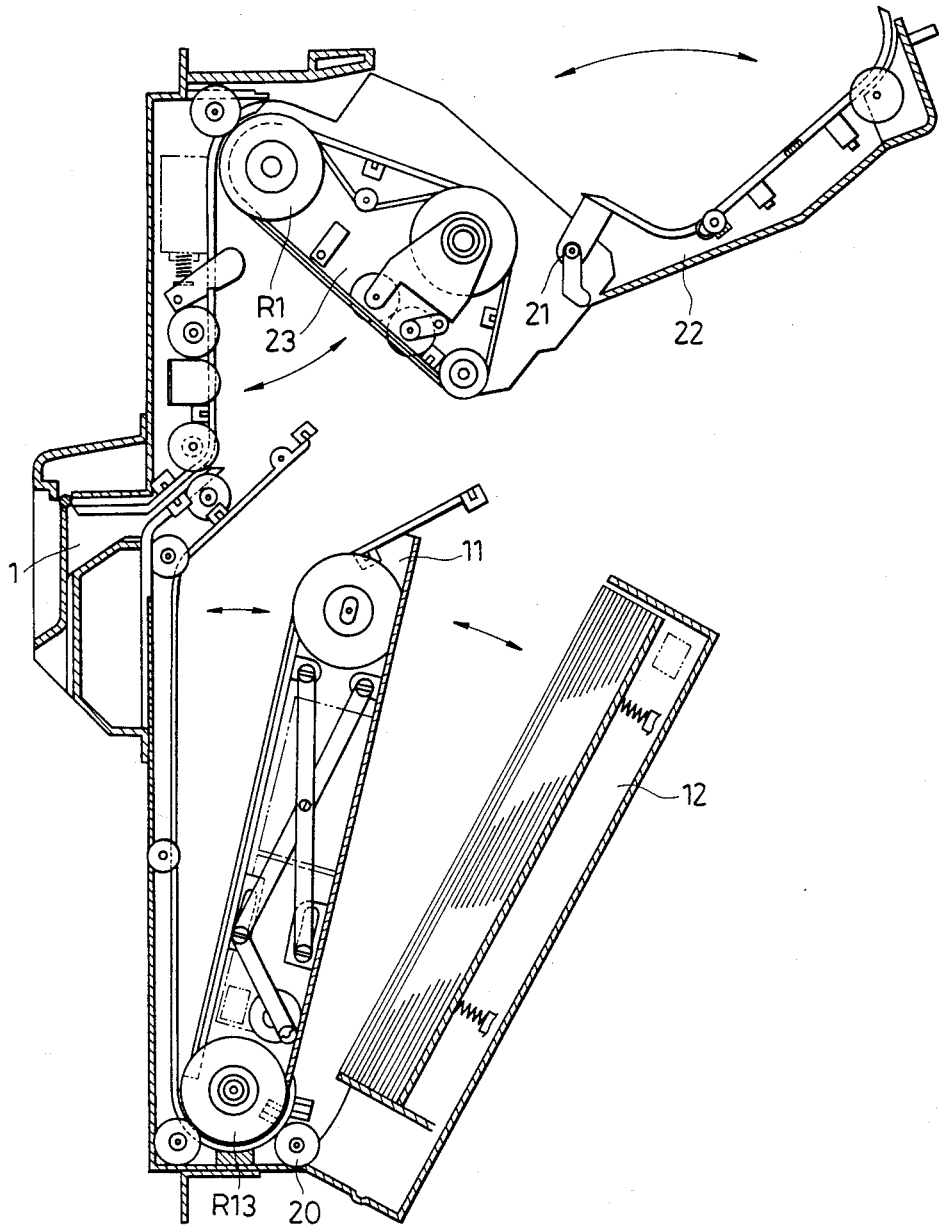
FIG. 4 is a view showing the same embodiment of which movable portions are disengaged so as to open the bill conveying passage.

Some of the components or portions defining the conveying passages 2, 3 are detachable so that these passages may be exposed. Specifically the latter half 3*b* of the second conveying passage 3 can be exposed by pivoting the accumulating box 12 into the position 12', as mentioned above. The section or block including the reciprocating means 11 can be pivoted backward on the shaft of the pulley R13, as shown in FIG. 4, so as to expose the former half of the second conveying passage 3. A section or block 22 including the latter half of the first conveying passage 2 can be pivoted on a shaft 21, as shown in FIG. 4, so as to expose the latter half of the first conveying passage 2. Further, a conveying drive block or section 23 in the space defined by the U-shaped conveying passage 2 can be pivoted on the shaft of the pulley R1 so as to expose the former half of the first conveying passage 2. Since the conveying passages 2 and 3 can be exposed throughout, clogging of a bill or bills can be cleared with ease.

Figure 5A:
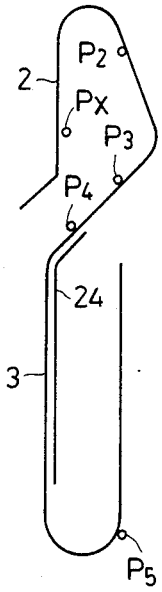
FIGS. 5*a* to 5*c* are schematic views showing a bill or bills temporarily retained in the device of the same embodiment.
Figure 5B:
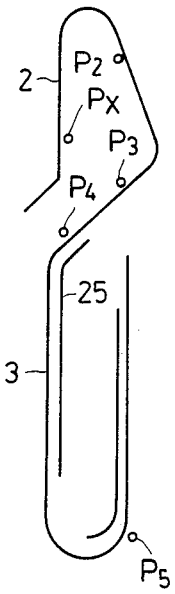
Figure 5C:
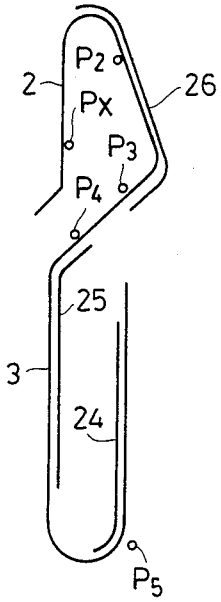

An example of the temporary bill-retention control as effected when a true bill is accepted will be described below. This control is effected mainly according to the outputs of the sensor $P_3$ at the exit of the first conveying passage 2 and the sensor $P_4$ at the entrance of the second conveying passage 3. The first true bill inserted is conveyed forward by the forward rotation of the motor M1 until the fore-end of the bill reaches the sensor $P_3$, when the second motor M2 is rotated in the forward direction to accept the bill to the second conveying passage 3. When finally the rear end of the first bill 24 reaches the sensor $R_4$, FIG. 5(*a*), the motor is stopped and sensor P4, as shown in the bill is retained. In case a second true bill 25 is inserted successive to the first bill, only the motor M1 is rotated in the forward direction until the fore-end of the bill 25 reaches the sensor $P_3$, when the motor M2 is rotated in the forward direction to convey the first bill 24 to the latter half of the second conveying passage 3 and the second bill 25 to the former half of the conveying passage 3 simultaneously. When the rear end of the second bill 25 reaches the sensor $P_4$, as shown in FIG. 5(*b*), the motor is stopped to retain the bills 24, 25 in the second conveying passage 3. In case a third true bill 26 is inserted successive to the second bill 25, only the motor M1 is rotated in the forward direction and, when the fore-end of the bill 26 reaches the sensor $P_3$, as shown in FIG. 5(*c*), the motor is stopped to retain the three bills in the respective positions they assume at this time. As a matter of course, an appropriate counting means is to be provided to count the number of inserted bills. Such conveying control according to the outputs of the sensors $P_3$, $P_4$ ensures that the inserted bills be kept apart from one another by a distance almost corresponding to the distance between the sensors $P_3$ and $P_4$, thereby preventing the overlapping of the bills being conveyed. To return the temporarily retained bill or bills, both motors M1 and M2 are rotated in the reverse direction as mentioned above to return part of the retained bills due to be paid back. For that purpose, the bills to be returned are counted by means of a counter utilizing the outputs of the sensors $P_3$, $P_4$, and the like.

To accumulate the retained bill in the box 12, the motor M2 is rotated in the forward direction until the rear end of the bill has passed the sensor $P_5$ and the bill is located in the latter-half straight portion 3*b* of the conveying passage 3, when the motor M3 is rotated as mentioned above to reciprocate the push plate 16. In case the sensors $P_{1L}$, $P_{1R}$ adjacent to the insertion slit 1 have detected insertion of a bill while the motor M3 is rotating, it is preferable to reversely rotate the motor M1 and return the inserted bill automatically. Thus, insertion of a bill is prevented when another bill is being accumulated in the box 12. However, in case the first bill 24 is to be accumulated in the box 12 when the third bill 26 is retained temporarily in the latter half of the first conveying passage 2, as shown in FIG. 5(*c*), it is to be ensured that the motor M1 not be reversely rotated and the motor M1 not be rotated in the forward direction even if the sensors $P_{1L}$, $P_{1R}$ have detected insertion of a bill.

When the bill accumulating box 12 has been filled to capacity, further accumulation of bills is no longer possible and further insertion of a bill must be prohibited. For that purpose, it is preferable to provide a fullness detection means and, upon detection of fullness, either prohibit the rotation of the motors M1, M2 or reversely rotate the motor M1 when the sensors $P_{1L}$, $P_{1R}$ have detected insertion of a bill so as to return the bill automatically. The fullness detection means can be a sensor provided in a certain fullness detection position in the accumulating box 12. Alternatively, that the accumulating box 12 has been filled to capacity can be known by detecting the overload applied to the motor M3 provided to drive the reciprocating means 11. An overload to the motor M3 may be recognized as such when the carrier switch SW1 has maintained the on-state longer than a predetermined period of time, for the compression plate 14 ceases to move in the direction of the arrow A when the accumulated amount has reached its limit and the rotation of the motor M3 is stopped halfway.

Still more preferably, a warning may be displayed to indicate the insertion prohibition state.

Figure 6:
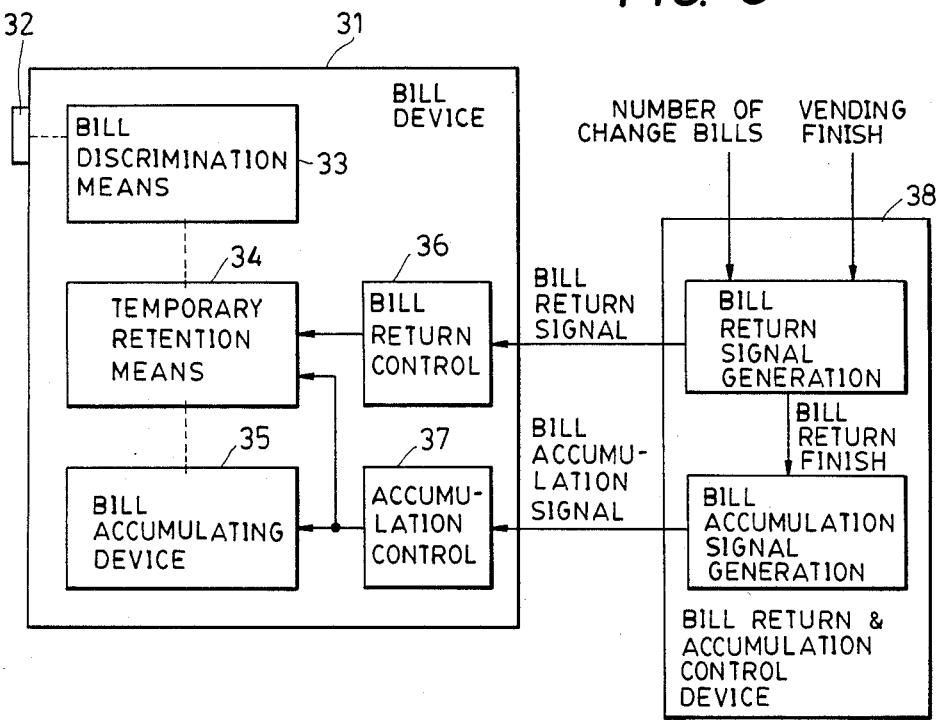
FIG. 6 is a block diagram showing the concept of the bill device according to the invention provided with a bill return and accept control device.

In case a plurality of bills are retained temporarily and part of them needs to be returned as change, the change preferably is returned before accumulating the balance in the box 12. For example, in case three bills are deposited by a user (customer) who first wishes to obtain an item from the vending machine having a purchase price which requires three bills and the user afterwards changes his mind because for instance, the first desired item is out of stock, and wishes to purchase another item having a purchase price which requires only two bills. The originally deposited three bills are retained as shown in FIG. 5(*c*). One of them is to be returned as change and the remaining two bills to be accepted. Preferably the motor M1 is reversely rotated to return the bill 26 first, thereafter accumulating the bills 24, 25 in the box 12. This is because since the accumulation operation takes a little time, it is preferable to give the bill return operation priority over the accumulation operation in order not to cause inconvenience to the users. FIG. 6 is a block diagram showing the concept of an embodiment of the invention where a return and accumulation control device 38 is provided in association with the bill device 31.

In FIG. 6, the bill device 31 comprises a bill discrimination means 33 for discriminating between false bills and true bills inserted from a bill insertion slit 32, a temporary retention means 34 capable of temporarily retaining a plurality of true bills accepted by the discrimination means 33, a bill accumulator 35 for accumulating the retained bills, a bill return means 36 for effecting a control of returning the bill retained in the temporary retention means 34 toward the insertion slit 32 in response to a bill return signal, and an accumulation control means 37 for effecting a control whereby the bill accumulation device is actuated to accumulate the bill retained in the temporary retention means 34 in response to a bill accumulation signal. A specific example of the structure and operation of the bill device 31 is shown in FIGS. 1 to 5. There is further provided in association with the bill device 31 the bill return and accumulation control device 38. The control device 38 ensures that, when part of a plurality of temporarily retained bills is to be accumulated and the remainder to be returned, the bill return signal be supplied to the bill return control means 36 by priority over the bill accumulation signal and subsequently the bill accumulation signal be generated and supplied to the control means 37, so that part of the retained bills due to be paid back may be first returned and subsequently the remainder may be accumulated in the bill accumulation device.

By way of example, the bill return and accumulation control device 38 is related to the vending control circuit of a vending machine, where the control device 38 generates the bill return signal for returning a certain number of bills corresponding to the change on the basis of a vending end signal, thereafter generating the bill accumulation signal. The arrangement that first the bill return signal for returning a number of bills due to be paid back is generated and subsequently the bill accumulation signal is generated makes it possible to return part of a pluraltiy of retained bills first and subsequently accumulate the remainder.

Figure 7:
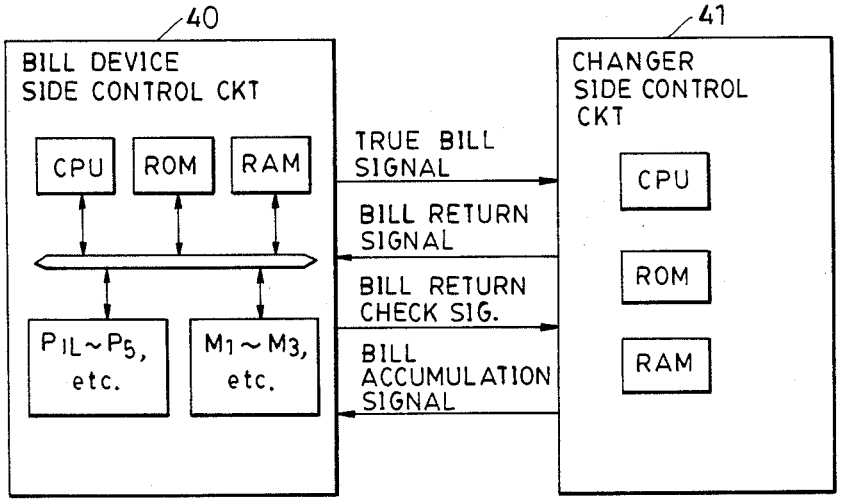
FIG. 7 is a block diagram schematically showing the hardware structure of the electric control device portion in the embodiment of the bill device according to the invention.

FIG. 7 generally illustrates the hardware structure as a specific embodiment of the electric control device portion of the construction shown in FIG. 6. The hardware structure shown consists of a bill device side control circuit block 40 and a changer side control circuit block 41. The block 40 comprises a microcomputer portion including CPU, ROM, and RAM, input elements including sensors $P_{1L}$, $P_{1R}$, $P_2$ to $P_5$, and output elements including motors M1 to M3. The block 41 is a vending control circuit block mounted in the changer of a vending machine and comprises a microcomputer portion including CPU, ROM, and RAM. The block 41 performs various vending control operations including the judgement operation based on the comparison between the deposited amount and the price for judging whether vending may be effected and calculation operation of calculating the deposited amount, change and the like. Describing only those signals supplied from the block 40 to the block 41 or vice versa which are related to the following description, a true bill signal is generated when the bill discrimination means (33 in FIG. 6) has judged the deposited bill to be true and supplied from the block 40 to the block 41. The bill return signal and the bill accumulation signal supplied from the block 41 to the block 40 are identical to those described previously referring to FIG. 6. A bill return check signal supplied from the block 40 to the block 41 is generated for confirmation when the return of one bill by the bill return control means (36 in FIG. 6) included functionally in the block 40 is completed. The accumulation control means (37 in FIG. 6) is included functionally in the block 40 while the bill return and accumulation control device (38 in FIG. 6) is included in the block 41 functionally.

Figure 8:
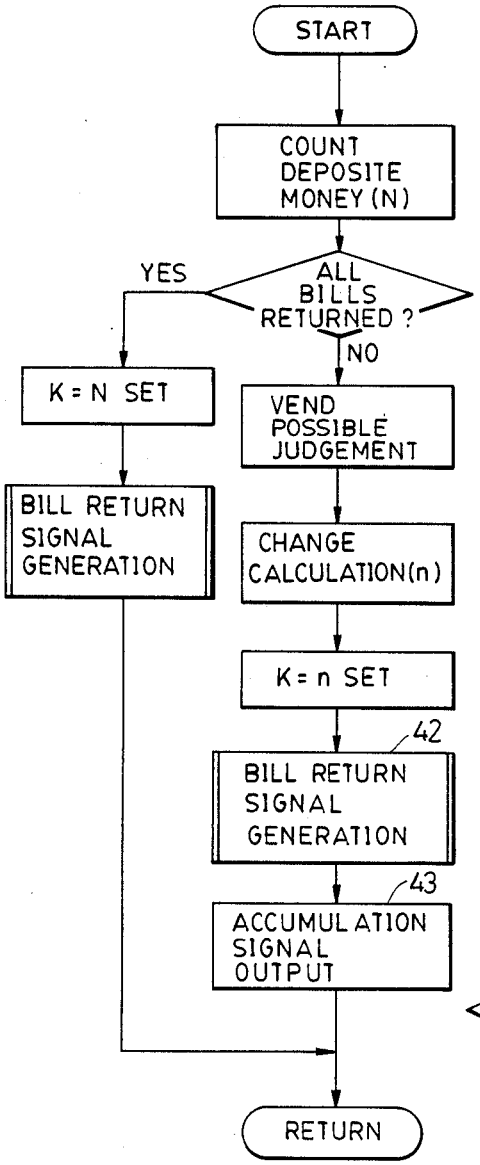
FIG. 8 is a flowchart showing the abstract of the vending control program carried out by the changer side control circuit shown in FIG. 7.

FIG. 8 generally shows the vending control program carried out by the microcomputer portion in the changer side control circuit block 41. First in the COUNT DEPOSITED MONEY, the deposited coins and/or bills are counted to find the amount deposited. The number of the deposited bills is obtained by counting the true bill signals. The count of the number of the bills is denoted by N. This N corresponds to the number of the bills retained temporarily in the bill device and is 3 at its maximum in the above embodiment. In ALL THE BILLS RETURNED?, it is checked whether or not return of all the deposited bills is demanded by the closure of an adjustment switch. When it is demanded, the contents of a register K are set to N (K=N), thereafter executing the BILL RETURN SIGNAL GENERATION subroutine.

When the return of all the deposited bills is not demanded, judgement is made as to permissibility of vending and, if permissible, a product is vended and the change calculated. The number of bills due to be paid back as change is denoted by n. When bills are not returned as change, n=0 whereas when bills are returned as change, the number of bills necessary for the change is n. Then the contents of the register K are set to n (K=n), thereafter executing the BILL RETURN SIGNAL GENERATION subroutine. In this BILL RETURN SIGNAL GENERATION subroutine, the bill return signal is produced indicating the number of bills required to prepare the change so that the bill device may effect the return control. Upon completing the return of a certain number of bills as change, the accumulation signal is produced. The BILL RETURN SIGNAL GENERATION subroutine shown as the block 42 and ACCEPT SIGNAL GENERATION shown as the block 43 correspond to the bill return and accumulation device 38 shown in FIG. 6.

Figure 9:
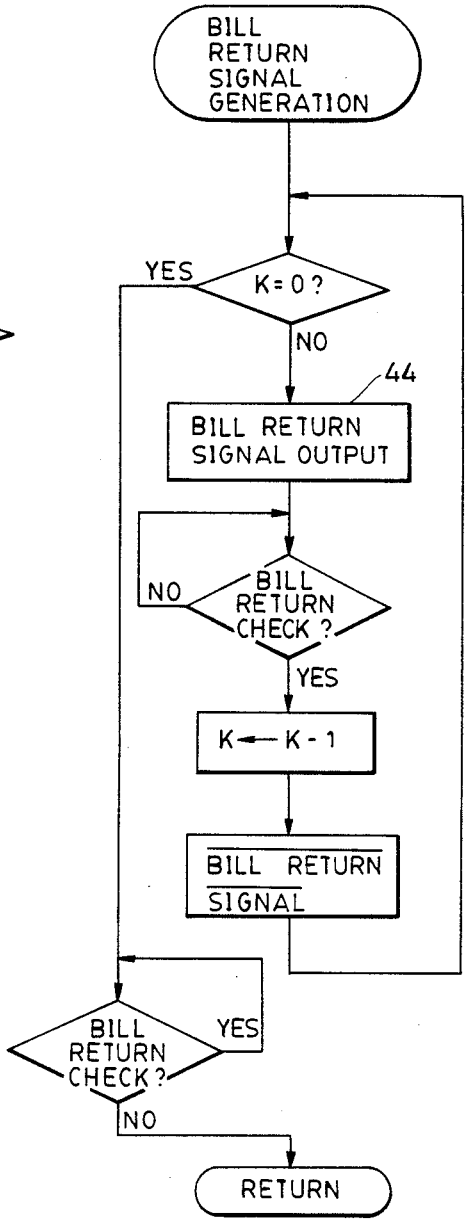
FIG. 9 is a flowchart of the bill return signal generating subroutine in FIG. 8.

FIG. 9 shows an example of the bill return signal generation subroutine. First the contents of the register K are examined to see whether they are 0 or not (K=0?). The contents of the register K show the number of bills to be returned. If NO, the bill return signal is produced (block 44) and supplied to the bill device side control circuit block 40 (FIG. 7). Nextly, it is checked whether or not the bill return check signal has been supplied from the control circuit block 40. If YES, it is meant that one bill has been returned. Therefore 1 is subtracted from the contents of the register K (K←K−1). Then the output of the bill return signal is stopped (bill return signal), returning to the judgement block "K=0?". If K≠0, the routine shown in FIG. 9 is repeated to produce the bill return signal repeatedly until K=0. When a number of bills due to be paid back have been all returned, "K=0? " is judged YES. Upon checking that the bill return check signal is eliminated, the bill return signal generation subroutine is ended and then the accumulation signal is produced (block 43 in FIG. 8).

Figure 10A:
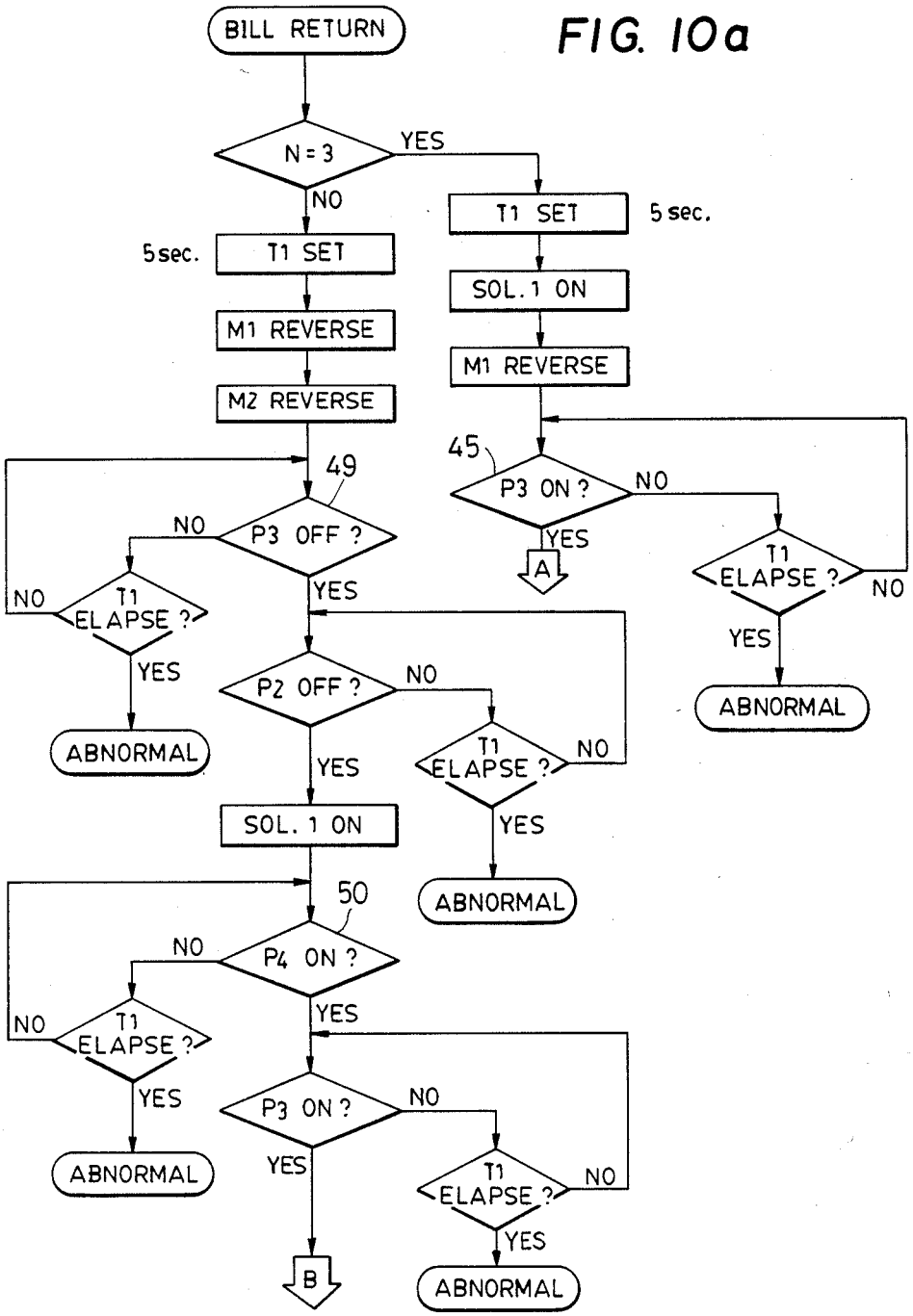
FIGS. 10(*a*) and 10(*b*) are flowcharts showing an example of the bill returning program carried out in the bill device side control circuit shown in FIG. 8.
Figure 10B:
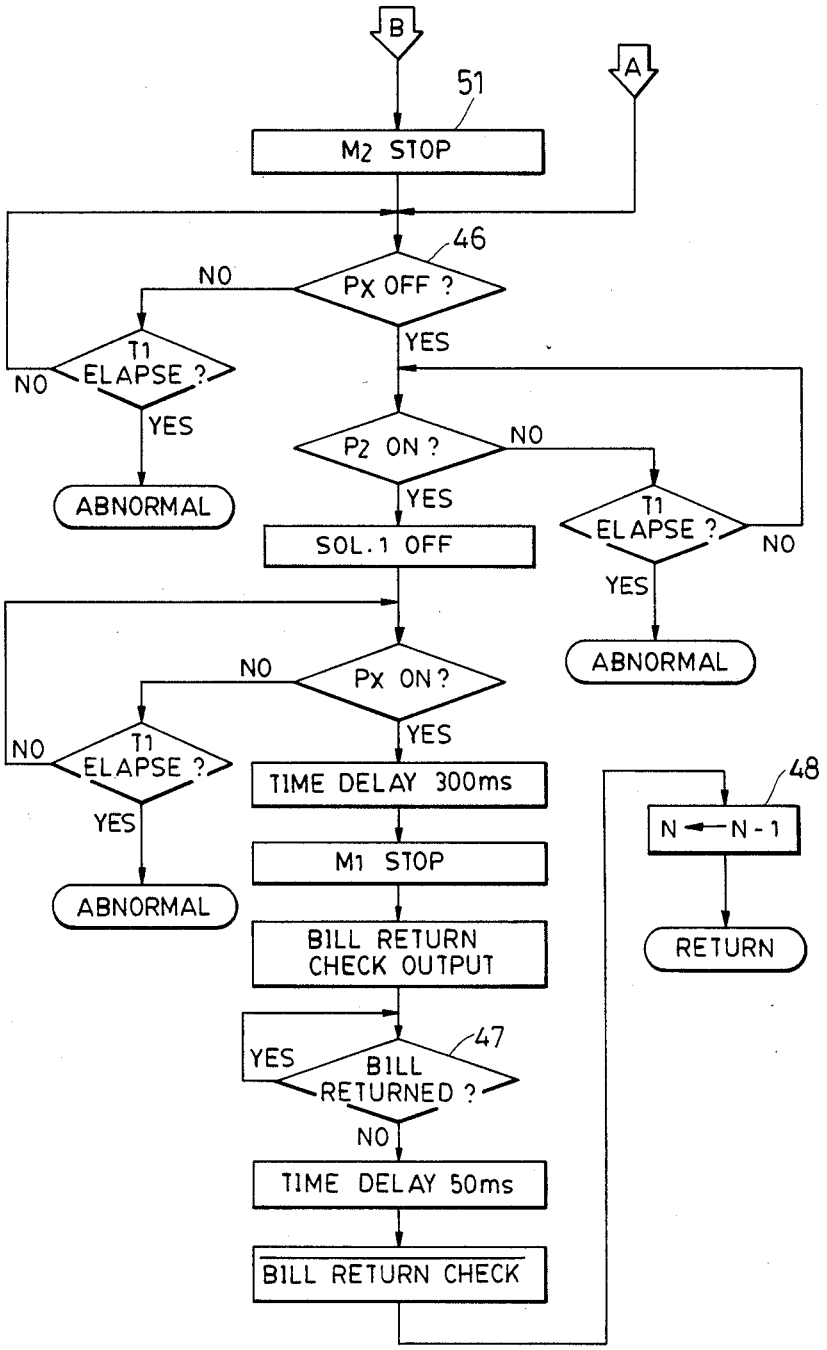
Figure 11A:
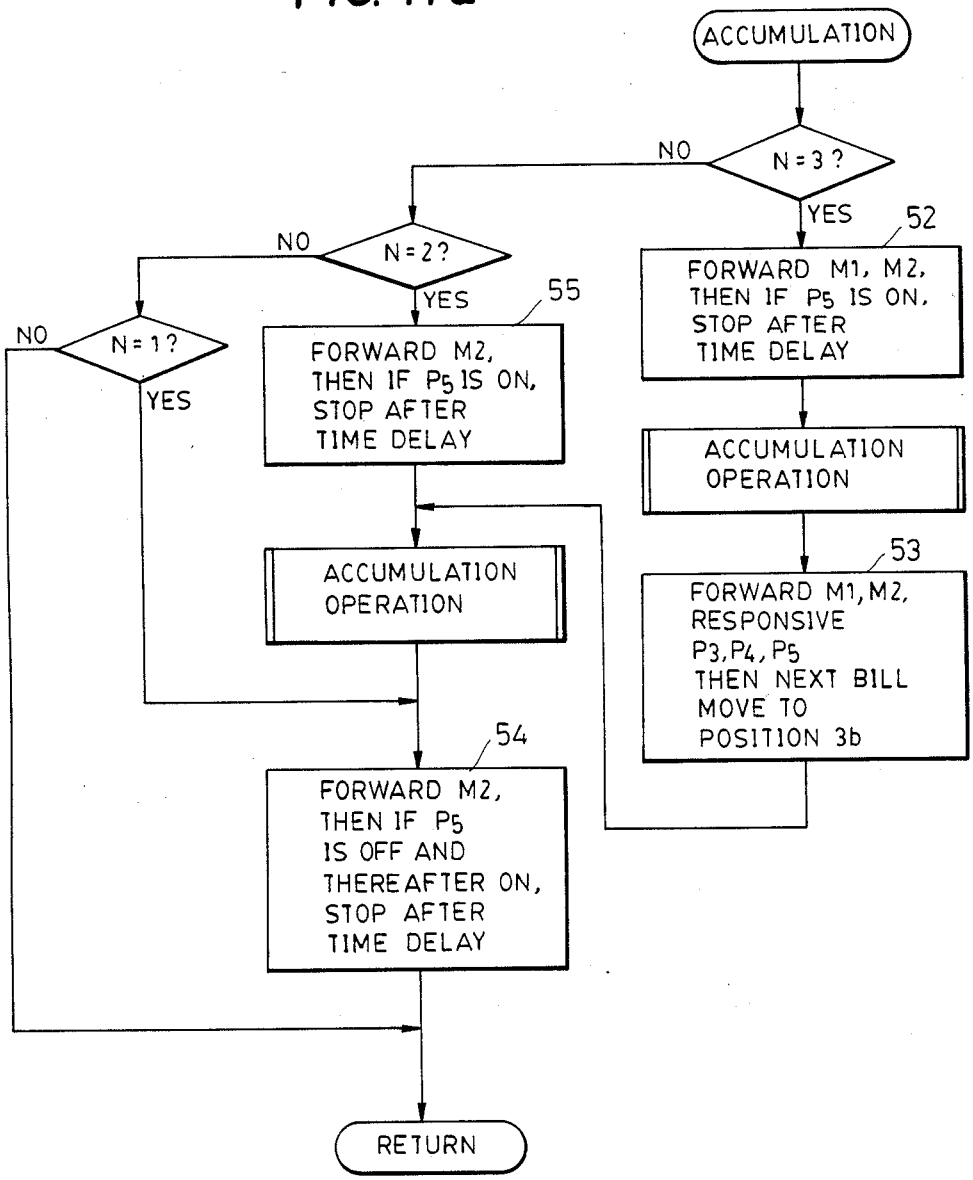
FIGS. 11(*a*) and 11(*b*) are flowcharts showing an example of the bill accepting program carried out in the bill device side control circuit.
Figure 11B:
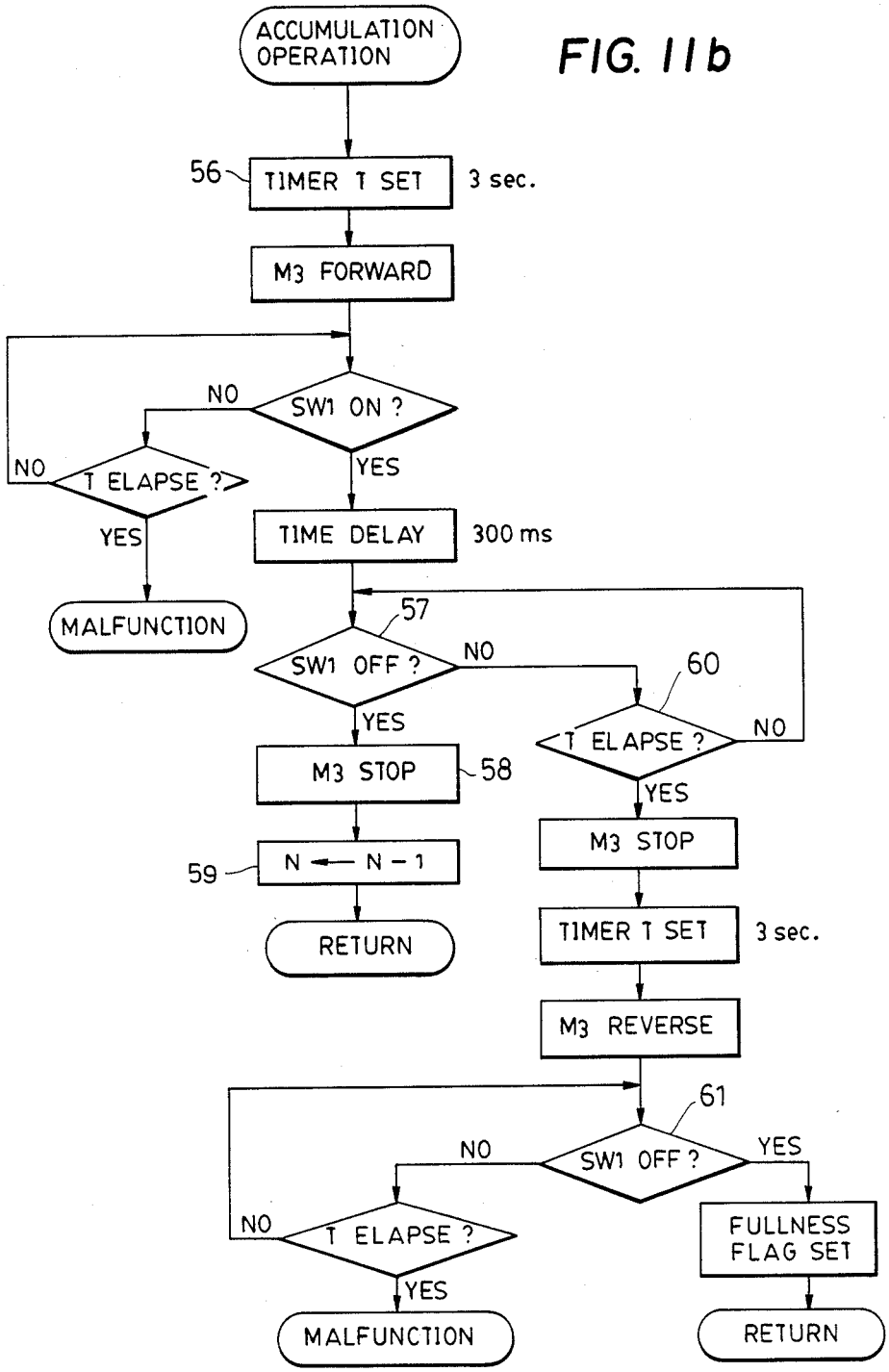

When supplied with the bill return signal from the changer side control circuit block 41 through the processing 44 in FIG. 9, the bill device side control circuit block 40 carries out the bill return program shown in FIGS. 10(*a*) and 10(*b*) and, when supplied with the accumulation signal through the processing 43 shown in FIG. 8, carries out the accumulation program shown in FIGS. 11(*a*) and 11(*b*). The bill return program shown in FIGS. 10(*a*) and 10(*b*) corresponds to the bill return control means 36 shown in FIG. 6 and the accumulation program shown in FIGS. 11(*a*) and 11(*b*) corresponds to the accumulation means 37. Note that the bill device side control block 41 also counts the number of the temporarily retained bills (number of the deposited bills) and denote said number by N.

In FIGS. 10(*a*) and 10(*b*), the characters T1 denotes a 5-second timer. The bill sensors $P_2$ to $P_5$ and $P_X$ are turned off upon detecting a bill and remain on while a bill is not detected. Accordingly when, for example, "$P_3$ OFF? " is judged YES, it is meant that a bill is now passing the sensor $P_3$.

Description will be first made as to the case where N=3, i.e., three bills are retained temporarily as shown in FIG. 5(*c*). In that case, "N=3? " is judged YES, setting the timer T1 and energizing the solenoid SOL1 so as to draw the lever 5. Thus, the return passage is opened and the motor M1 is reversely rotated. Then it is checked whether or not the sensor $P_3$ has been turned on (block 45). The sensor $P_3$ is turned on when the rear end of the first bill has passed the sensor $P_3$ as that bill is conveyed reversely. Subsequently the step jumps to the block 46 shown in FIG. 10(*b*) through a connection point A. In the block 46, it is checked whether or not the sensor $P_X$ detected the bill. The sensor $P_X$ is turned off when the fore-end of the reversely conveyed bill passes the sensor $P_X$. Then the sensor $P_2$ is turned on when the rear end of the bill has passed the sensor $P_2$, whereupon the solenoid SOL1 is turned off. Subsequently a time delay of 300 ms is set on condition that the sensor $P_X$ has been turned on, during which delay the bill is let out from the insertion slit 1, thereafter stopping the drive of the motor M1 and producing the bill return check signal. As mentioned above, the bill return check signal is supplied to the changer side control circuit block 41 and, when receipt of the bill return check signal is confirmed in the program shown in FIG. 9, the bill return signal is eliminated. In the block 47 in FIG. 10(*b*), it is judged whether the bill return signal has been eliminated and, upon elapse of a 50 ms-delay from elimination of the bill return signal, the bill return check signal is eliminated. Then 1 is subtracted from the contents of the retained-bill counter N through the processing in the block 48. Thus terminates one cycle of the bill return program as one bill is paid back. Upon discharge of one bill, the remaining two bills are retained in the manner as shown in FIG. 5(*b*).

When two bills are retained temporarily, "N=3? " in FIG. 10(*a*) is judged NO. Upon setting the timer T1, the motors M1 and M2 are both reversely rotated. The block 49 judges whether or not the fore-end of the bill has reached the sensor $P_3$. If YES, it is checked whether the bill has reached the sensor $P_2$. If YES, the solenoid SOL1 is actuated to open the return passage. Then a block 50 checks whether the rear end of the bill has passed the sensor $P_4$. If YES, it is further checked whether said rear end has passed the sensor $P_3$. If YES, the step proceeds through a connection point B to a block 51 in FIG. 10(*b*) where the motor M2 is stopped. Accordingly, the bill deposited earlier stops almost in the position 24 shown in FIG. 5(*a*) while the bill deposited later is further conveyed reversely down the conveying passage 2 as the motor M1 reversely rotates. The processing in the block 46 and the following processings are carried out as mentioned above so that upon elimination of the bill return check signal, 1 is further subtracted from N by the processing in the block 48. The one bill left is retained in the position 24 shown in FIG. 5(*a*).

When one bill is temporarily retained, the program carried out is exactly the same as that shown in FIGS. 10(*a*) and 10(*b*) carried out in case two bills are retained as described immediately above so that when the return of the bill is completed, N=0 by the processing in the block 48.

Now FIGS. 11(*a*) and 11(*b*) will be described. FIG. 11(*a*) shows the accumulation program in its entirety of which the ACCUMULATION OPERATION subroutine is shown in detail in FIG. 11(*b*).

When N=3, i.e., when three bills are temporarily retained, the processing in the block 52 in FIG. 11(*a*) is carried out first. More specifically, the motors M1, M2 are rotated in the forward direction and, after the rear end of the bill to be first accumulated has passed the sensor $P_5$ (i.e., after the sensor $P_5$ has been truned on), a given time delay (e.g., about 100 ms)is set. Then the motors M1, M2 are stopped with the bill brought just in the straight latter half 3*b* of the conveying passage 3 In this state, the accumulation operation subroutine is executed so as to accumulate the bill in the straight portion 3*b* into the box 12. Subsequently the motors M1, M2 are rotated in the forward direction on the basis of the outputs of the sensors $P_3$, $P_4$, $P_5$ in the processing of the block 53 so as to bring the second bill to the straight latter half 3*b* of the conveying passage 3. Then the accumulation operation subroutine is executed to accumulate the bill located in the straight portion 3*b* into the box 12. Thereafter, the processing of the block 54 is executed and the motor M2 is rotated in the forward direction. The motor M2 is stopped upon lapse of a pretermined period of time from confirming that the sensor $P_5$ has been once turned off and then has been turned on thereby causing the bill to be located in the straight latter half 3*b* of the conveying passage 3. The bill accumulation operation subroutine is executed in this state to accumulate the bill into the box 12.

If the accumulation signal is supplied when N=2, i.e., when two bills are temporarily retained, "N=3? " is judged NO so that, through YES of "N=2?", the processing of the block 55 is carried out. In that processing, the motor M2 is rotated in the forward direction to convey the bill forward until, upon elapse of a predetermined period of time since the sensor $P_5$ was turned on, the bill 24 is brought in the straight portion 3*b* as shown in FIG. 5(*b*), when the motor M2 is stopped. Subsequently the accumulation operation subroutine is executed to accumulate the bill in the box 12. Then the processing of the block 54 is executed and the accumulation operation subroutine is again executed to accumulate another bill in the box 12.

If the accumulation signal is supplied when N=1, i.e., when one bill is temporarily retained, the step proceeds through NO of "N=3?", NO="N=2? " and YES of "N=1? " to the processing of the block 54. Thereafter accumulation operation subroutine is executed.

FIG. 11(*b*) shows an example of the accumulation operation subroutine including the overload detection means as mentioned above for detecting an overload applied to the motor M3 using a timer (fullness detection means for the box 12). First a 3-second timer T is started (block 56) and the motor M3 is rotated in the forward direction. Then the normal control is effected as the step proceeds from the block 56 to the block 59, where the carrier switch SW1 is turned on and then off in the time period set by the timer. The motor M3 stops rotating as the switch SW1 is turned off (block 58). Thus one rotation of the motor M3 is controlled and one bill that was located in the straight latter half 3*b* of the conveying passage 3 is accumulated in the box 12. In a block 59, 1 is subtracted from the contents of the counter N which counts the temporarily retained bills. The route NO from the block 57 is provided to detect the overload. Specifically in case the switch SW1 is not turned off upon elapse of a time period provided by the timer T (YES of a block 60), the motor M3 is stopped, the timer T is set again and the motor M3 is rotated reversely. Checking that the carrier switch has been turned off (YES of a block 61), a fullness detection flag is set. When the fullness detection flag is set, a fullness warning is displayed to prohibit further deposition of bills.

Description will now be made by way of example on the case where N=3, i.e., three bills are temporarily retained, n=1, i.e., one bill is to be returned as change, and two bills are to be accumulated. In the changer side control circuit block 41, K and n are set to 1 by the processing shown in FIG. 8 and the processing in FIG. 9 is carried out. In FIG. 9, the bill return signal is produced in the block 44 then the processing step stands by until the bill return check signal returns. In the meantime in the bill device side control circuit block 40, the bill return signal is accepted to execute the bill return program shown in FIGS. 10(*a*) and 10(*b*). In this case, since where N=3, the step proceeds through YES of "N=3" to the processings of SET T1, SOL1 ON, and ROTATE M1 REVERSELY. Checking that the sensor $P_3$ is on, the step proceeds through A to the block 46 in FIG. 10(*b*). After execution of further processings up to STOP M1, one bill is returned (the bill 26 in FIG. 5(*c*)). Then the bill return check signal is produced, whereupon the step stands by in the block 47 until the bill return signal is eliminated.

In the meantime in FIG. 9, upon confirming that the bill return check signal has been provided, 1 is subtracted from the register K, whereupon the bill return signal is eliminated. As a result of "1−1", the contents of the register K become "0", so that the bill return signal is not produced any more. Therefore the step stands by until the bill return check signal is eliminated.

In the meanwhile in FIG. 10(*b*), elimination of the bill return signal is checked in the block 47 before eliminating the bill return check signal. Subsequently the processing "N←N−1" is executed to subtract 1 from the count N showing the number of the temporarily retained bills.

In FIG. 9, in the meantime, elimination of the bill return check signal is checked before ending the bill return signal generation processing, followed by generation of the accumulation signal shown in the block 43 in FIG. 8.

In the meanwhile in the bill device side control circuit block 40, the accumulation signal is accepted to execute the accumulation program shown in FIGS. 11(*a*) and 11(*b*). In this case, since one bill was returned previously, N=2 so that the processing of the block 55 shown in FIG. 11(*a*) is carried out followed by execution once of the accumulation operation subroutine shown in FIG. 11(*b*). Subsequently one bill is accumulated in the box 12 so N=1 by the processing "N←N−1" (block 59). Then the step proceeds to the processing of the block 54 in FIG. 11(*a*), whereupon the accumulation operation subroutine is executed again. Thus the remaining bills are all accumulated and the accumulation processing ends with N=0.

While in the above embodiment, the portion corresponding to the bill return and accumulation control device 38 is incorporated in the changer side circuit, it may be incorporated in the bill device side circuit.

Power failure can occur while deposited bills are somewhere in the conveying passages 2 and 3. In case power failure should occur, it is preferable at the time of turning on of the bill device after the power supply is resumed to carry out an appropriate initial processing whereby to automatically return all the bills remaining in the conveying passages 2 and 3 so as to avoid malfunction. In one example of such initial processing, judgement is made in which manner a bill or bills remain in the conveying passage 2 or 3 or both on the basis of the output signals of the sensors $P_2$, $P_3$, $P_4$, and $P_5$ out of all the possible manners presupposed and based on that judgement, the motors M1 and M2 are effectively rotated reversely or, as the case may be, in the forward direction to obtain the exact location of the bill or bills, thus enabling an automatic return of the bills left in the conveying passage. To obtain the location of the bills using a small number of sensors, it is effective to rotate the motors M1, M2 either reversely or forwardly as the case may be according to the outputs of the sensors employed. Alternatively, the bills stopped halfway may be counted instead of returning then automatically. It is also possible to return only the number of bills due as change rather than returning all the bills automatically For that purpose, it is feasible to store the number of the temporarily retained bills, the number of bills due to be returned as change, and the like in a battery backup memory or nonvolatile memory so that, upon locating the retained bills in the manner described, only those bills due to be paid back may be returned.

The bill device according to the invention may have a horizontally elongated shape rather than a vertically elongated shape. In that case, the bill insertion slit is directed upward so adequate measures must be taken to prevent admission of rainwater and the like when the bill device is installed outdoors. In the case of a vertically elongated structure as shown in FIG. 1, the bill insertion slit 1 is directed sideward so that admission of rainwater can be better prevented. As shown, the slit 1 is provided with a cover 27 of which the upper side is pivotally secured to the casing. The cover 27 is turned upward with a hand when inserting a bill. The cover 27 serves to prevent admission of rainwater.

As described above, the bill device according to the invention comprises an elongated casing having a bill insertion slit almost in the center thereof, both halves of which casing accommodate U-shaped conveying passages communicating with each other, the beginning end of these connected conveying passages communicating with the bill insertion slit while the terminal end being provided with the bill accumulator. Such structure of the bill device, despite its compactness, enables a relatively large number of bills to be temporarily retained halfway in the conveying passage. Also, because of the arrangement whereby the bill stopped halfway in the conveying passage is returned, the bill device according to the invention suffers malfunction less frequently than a bill device whereby the bill or bills once stored in the accumulator are returned.

Further the bill return and accumulation device according to the invention makes it possible to accumulate part of a plurality of the temporarily retained bills and return the remainder as change, the bill return operation preceding the bill accumulation operation. This arrangement that a quick return of a bill or bills as change is allowed to precede a relatively time-consuming bill accumulation operation helps avoid inconvenience that would otherwise be caused to the users.

What is claimed is:

1. A bill device of the type which discriminates a true bill from a false bill among bills inserted into a bill insertion slit, which temporarily retains a true bill which has been accepted after discrimination, and which has selective capability for returning the retained bill toward the bill inserting slit and for accepting the same into a bill accumulating device as required, characterized in that:

a main body of said bill device is constituted of a relatively elongated casing, said bill insertion slit is formed substantially in the center of said casing in its longitudinal direction, a first U-shaped bill conveying passage communicating with said bill insertion slit is provided in one half of said casing and a second U-shaped bill conveying passage communicating with said first U-shaped bill conveying passage is provided in another half of said casing, bill discrimination means is disposed in the half of said first U-shaped bill conveying passage nearest said bill insertion slit, and said bill accumulating device is disposed in the latter half of said second bill conveying passage, said latter half being the half furthest from said bill insertion slit, said bill conveying passages being sufficiently long so that a plurality of bills after discrimination can be retained in said two U-shaped bill conveying passages, and wherein:

said casing is elongated in the vertical direction, said insertion slit is disposed substantially in the center of a front panel of said casing, said first U-shaped bill conveying passage is inverted U-shaped and said second U-shaped bill conveying passage is uninverted U-shaped, one end of said inverted U-shaped bill conveying passage communicates with said bill insertion slit and the other end thereof communicates with one end of said uninverted U-shaped bill conveying passage thereby forming a substantially S-shaped conveying passage as a whole, and wherein;

the members of said casing about both of said respective U-shaped bill conveying passages are relatively movable, thereby enabling said respective bill conveying passages to be opened.

2. A bill device as defined in claim 1 wherein said bill accumulating device provided in the latter half of said uninverted U-shaped bill conveying passage consists of reciprocating means disposed in a U-shaped space in said uninverted U-shaped bill conveying passage and a bill accumulating box provided on the opposite side of said reciprocating means across the latter half of said uninverted U-shaped bill conveying passage, and said reciprocating means accumulates bills in said bill accumulating box by pushing bills in said latter half of said uninverted U-shaped bill conveying passage toward said box.

3. A bill device as defined in claim 2 wherein said bill accumulating box can be tilted backwardly when accumulated bills are collected.

4. A bill device of the type which discriminates a true bill from a false bill among bills inserted into a bill insertion slit, which temporarily retains a true bill which has been accepted after discrimination, and which has selective capability for returning the retained bill toward the bill insertion slit and for accepting the same into a bill accumulating device as required, characterized in that:

a main body of said bill device is constituted of a relatively elongated casing, said bill insertion slit is formed substantially in the center of said casing in its longitudinal direction, a first U-shaped bill conveying passage communicating with said bill insertion slit is provided in one half of said casing and a second U-shaped bill conveying passage communicating with said first U-shaped bill conveying passage is provided in another half of said casing, bill discrimination means is disposed in the half of said first U-shaped bill conveying passage nearest said bill insertion slit, and said bill accumulating device is disposed in the half of said second bill conveying passage furthest from said bill insertion slit, said bill conveying passages being sufficiently long so that a plurality of bills after discrimination can be retained in said two U-shaped bill conveying passages, and wherein:

said casing is elongated in the vertical direction, said insertion slit is disposed substantially in the center of a front panel of said casing, said first U-shaped bill conveying passage is inverted U-shaped and said second U-shaped bill conveying passage is uninverted U-shaped, one end of said inverted U-shaped bill conveying passage communicates with said bill insertion slit and the other end thereof communicates with one end of said uninverted U-shaped bill conveying passage thereby forming a substantially S-shaped conveying passage as a whole, and wherein:

said inverted U-shaped bill conveying passage is provided with a first bill conveying belt and a first motor for driving said belt, said uninverted U-shaped bill conveying passage is provided with a second bill conveying belt and a second motor for driving said second bill conveying belt, a communicating section between said inverted U-shaped bill conveying passage and said uninverted U-shaped bill conveying passage consists of a bill passage space where there is no bill conveying belt and is provided with a first sensor in a position nearer to said inverted U-shaped bill conveying passage and a second sensor in a position nearer to said uninverted U-shaped bill conveying passage, and outputs of said first and second sensors are used for driving control of said first and second motors.

5. A bill device of the type which discriminates a true bill from a false bill among bills inserted into a bill insertion slit, which temporarily retains a true bill which has been accepted after discrimination, and which has selective capability of returning the retained bill toward the bill insertion slit and for accepting the same into a bill accumulating device as required, characterized in that:

a main body of said bill device is constituted of a relatively elongated casing, said bill insertion slit is formed substantially in the center of said casing in its longitudinal direction, a first U-shaped bill conveying passage communicating with said bill insertion slit is provided in one half of said casing and a second U-shaped bill conveying passage communicating with said first U-shaped bill conveying passage is provided in another half of said casing, bill discrimination means is disposed in the half of said first U-shaped bill conveying passage nearest said bill insertion slit, and said bill accumulating device is disposed in the half of said second bill conveying passage furthest from said bill insertion slit, said bill conveying passages being sufficiently long so that a plurality of bills after discrimination can be temporarily retained in said two U-shaped bill conveying passages, and which further comprises:

bill return control means for returning a temporarily retained bill toward and through said bill insertion slit in response to a bill return signal;

accumulating control means for accepting a temporarily retained bill into said bill accumulating device in response to an accumulating signal; and bill return and accept control means for generating said bill return signal when the temporarily retained bill is to be returned and for generating said bill accumulation signal when the temporarily retained bill is to be accepted, and for supplying said generated bill return and bill accumulation signals to said bill return control means and to said bill accumulation control means respectively, and said bill return and accept control means generates, in case of accepting some temporarily retained bills and returning the rest, said bill return signal prior to said bill accumulation signal and supplies said bill return signal to said bill return control means, thereby returning a required number of bills first from among the temporarily retained bills, and thereafter supplies said subsequently generated bill accumulation signal to said accumulation control means for then accepting the rest of said temporarily retained bills into said bill accumulating device.

6. A bill device as defined in claim 5 wherein said bill return control means effects such a control that, each time said bill return signal is provided, one of said temporarily retained bills is returned and a bill return check signal is produced and said bill return and accept control means counts said bill return check signal and generates said bill return signals repeatedly until the required number of bills have been returned and thereafter generates said accumulation signal.

7. A bill validator of the type in which a bill is conveyed along a bill passage said validator comprising:

a housing, said validator including a true bill discrimination part having validation sensors and a bill accumulation part both disposed within said housing said bill passage comprising a first path passing through the discrimination part and a second path continuing the first path and passing through the accumulation part, guide members within said housing defining said bill passage, the guide members including a plurality of belts, for conveying the bill along the bill passage;

said housing having a relatively stationary first portion and a relatively moveable second portion mounted for movement relative to the first portion, said second portion constituting a relatively moveable bill accumulating box forming a portion of said bill accumulation part, said bill accumulating box including compression means for compressively holding bills therein;

certain of the guide members of said bill passage being attached to said stationary first portion and others of the guide members being attached to said relatively moveable second portion, wherein movement of said second portion away from said first portion moves said other guide members away from said certain guide members so as to expose portions of the bill accumulation part and the bill passage passing therethrough and thereby permit removal of bills lodged in said exposed portions of the bill accumulation part and bill passage.

8. A bill validator in which a bill is conveyed along a bill passage to a bill accumulation area, said validator comprising:

a housing having a relatively stationary section and other relatively moveable sections, said bill accumulation area being within said housing, at least one validation sensor disposed within said housing;

said bill passage being defined by a plurality of guide members, the guide members including a plurality of belts for conveying the bill along the bill passage, certain guide members being situated on one side of said bill passage and others of said guide members being situated on the other side of said bill passage, at least one of the guide members on one side of said bill passage being attached to one section of said housing and at least another of the guide members, situated on the opposite side of said bill passage from said at least one guide member, being attached to another of said sections, so that when said one and another housing sections are moved relative to one another, the correspondingly defined bill passage will be opened and exposed so as to permit removal of a bill lodged therein, said bill accumulation area including a bill accumulating box having compression means for compressively accumulating and holding bills therein, the bill accumulating box being formed of a first of said relatively moveable housing sections, such that movement of said first section forming the bill accumulating box relative to another second section will expose said bill accumulating box to permit removal of accumulated bills therefrom.

9. A bill validator in which a bill is conveyed along a bill passage to a bill accumulation area, said validator comprising:

a housing having a relatively stationary section which includes validation sensors, a second section which includes means for conveying a bill past the validation sensors and which is relatively moveable with respect to said stationary section and a third section which includes reciprocating means for pushing bills into the bill accumulation area and which is relatively movable with respect to said stationary and second sections, said bill accumulation area being within said housing and including means for compressively holding bills, said bill passage being defined by a plurality of guide members, the guide members including a plurality of belts for conveying the bill along the bill passage, certain of which guide members are situated on one side of said bill passage and others of which are situated on the other side of said bill passage, wherein a first set of said guide members on one side of said passage are attached to said stationary housing section, and a second set of said guide members are attached to said second housing section, so that when said second section is moved relative to the said stationary section the region of said bill passage defined by said first and second sets of guide members will be exposed so as to permit removal of a bill lodged therein.

10. A bill validator according to claim 9 wherein said bill passage region defined by said first and second sets of guide members communicates with an additional bill passage region, one side of said other bill passage region being defined by a third set of guide members attached to said third housing section, said third section constituting a bill accumulating box, so that when said third section is moved relative to said second section, said additional bill passage region and said accumulating box will be exposed to permit removal of bills lodged therein.

11. A bill validator according to claim 10 wherein said third section is pivotally attached to said second housing section.

* * * * *